US008231350B1

(12) United States Patent
Liang et al.

(10) Patent No.: US 8,231,350 B1
(45) Date of Patent: Jul. 31, 2012

(54) TURBINE ROTOR BLADE

(75) Inventors: George Liang, Palm City, FL (US); John E Ryznic, Palm Beach Gardens, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 674 days.

(21) Appl. No.: 12/500,033

(22) Filed: Jul. 9, 2009

(51) Int. Cl.
*F01D 5/18* (2006.01)

(52) U.S. Cl. ..... 416/97 R

(58) Field of Classification Search ..... 416/96 R, 416/97 R; 415/115
See application file for complete search history.

(56) References Cited

U.S. PATENT DOCUMENTS 4,416,585 A * 11/1983 Abdel-Messeh ..... 416/97 R
6,164,913 A * 12/2000 Reddy ..... 416/97 R
6,227,804 B1 * 5/2001 Koga et al. ..... 416/96 R
7,300,250 B2 * 11/2007 Papple ..... 416/96 R

* cited by examiner

*Primary Examiner* — Ninh H Nguyen
(74) *Attorney, Agent, or Firm* — John Ryznic

(57) ABSTRACT

A turbine rotor blade with a serpentine flow cooling circuit to provide cooling for the airfoil section, where the serpentine flow circuit is formed of a series of up-pass channels and at least one down-pass channel, and where the up-pass channels are formed by a series of impingement cavities separated by slanted ribs each with an impingement hole to direct impingement cooling air against the backside surface of the airfoil wall for cooling, and where the down-pass channel or channels is an open channel to minimize a pressure loss in the cooling air flow. Rotation of the blade produces a centrifugal force on the cooling air flow that increases the pressure of the impingement cooling air at the blade outer radial span wise direction.

6 Claims, 4 Drawing Sheets

TURBINE ROTOR BLADE

FEDERAL RESEARCH STATEMENT

None.

CROSS-REFERENCE TO RELATED APPLICATIONS

None.

BACKGROUND OF THE INVENTION

1. Field of the Invention

The present invention relates generally to a gas turbine engine, and more specifically to an air-cooled turbine rotor blade with a serpentine flow cooling circuit.

2. Description of the Related Art Including Information Disclosed Under 37 CFR 1.97 and 1.98

In a gas turbine engine, a high temperature gas flow is passed through the turbine to produce mechanical work to drive the compressor and, in an industrial gas turbine engine, to also drive an electric generator and produce electrical energy. Passing a higher temperature gas flow into the turbine can increase the efficiency of the engine. However, the turbine inlet temperature is limited by the material properties of the first stage stator vanes and rotor blades as well as the amount of cooling that can be produced by passing cooling air through these airfoils (vanes and blades). Airfoil designers try to minimize the amount of cooling air used in the airfoils since the cooling air is typically bled off from the compressor and thus is not used to produce work and the energy used to compress the air is thus wasted.

FIGS. 1 and 2 show a prior art turbine rotor blade with a triple pass serpentine flow cooling circuit design. The serpentine flow circuit is used in order to lengthen the flow path through the airfoil. However, for a blade with a single cooling flow circuit, cooling air is supplied through the blade leading edge flow channel with a leading edge showerhead design while a majority of the cooling air is discharged through the blade trailing edge. A blade cooling of the FIG. 1 design requires a high cooling air supply pressure to fulfill the blade leading edge showerhead back flow margin (BFM) where the internal pressure is higher than the external blade pressure to prevent the hot gas from flowing into the blade cooling circuit and the second leg down pass out flow margin (OFM) requirements. In addition, high cooling supply pressure will normally cause a high-pressure ratio across the blade trailing edge. The high pressure ratio across the blade trailing edge will yield small cooling features which decrease the casting yield and increase the variation of cooling flow. An alternative way to provide an effective cooling design arrangement for a low cooling flow design with high cooling supply pressure of a single triple pass serpentine blade is to use multiple compartment cavities and backside impingement with a single impingement metering hole to control the serpentine internal pressure distribution.

BRIEF SUMMARY OF THE INVENTION

It is an object of the present invention to provide for a turbine rotor blade with a single cooling flow circuit having a low cooling air flow design.

It is another object of the present invention to provide for a turbine rotor blade with a lower cooling air supply pressure than that of the cited prior art blade design.

It is another object of the present invention to provide for a turbine rotor blade with a lower pressure ratio across the blade trailing edge than that of the cited prior art blade design.

It is another object of the present invention to provide for a turbine rotor blade in which the centrifugal effects due to blade rotation will aid in the cooling air flow through the blade.

These objectives and more are achieved in the turbine rotor blade with the internal cooling air circuit of the present invention. The blade includes a multiple pass serpentine flow cooling circuit with up-pass legs and down-pass legs in which the up-pass legs include multiple impingement cavities connected in series while the down-pass legs are unrestricted to minimize the pressure loss along the leg. The up-pass legs include cavities formed by slanted impingement ribs each with an impingement hole directed to discharge impingement cooling air against the backside wall of the blade leading edge. The cooling airflow is forced through the up-pass legs by centrifugal force due to the blade rotation.

DETAILED DESCRIPTION OF THE INVENTION

Figure 1:
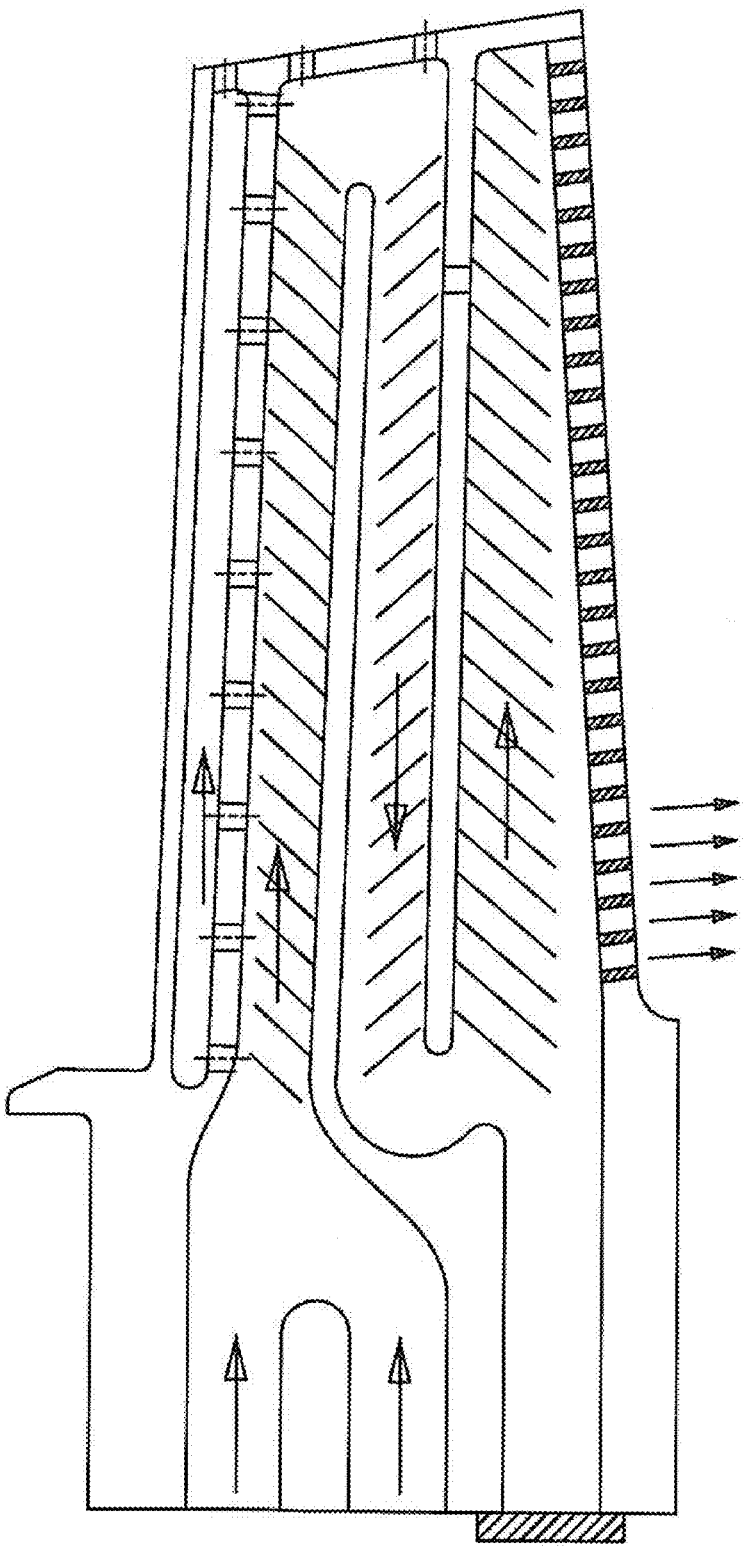
Fig 1 Prior Art
FIG. 1 shows a cross section side view of a prior art turbine rotor blade triple pass serpentine flow cooling circuit.
Figure 2:
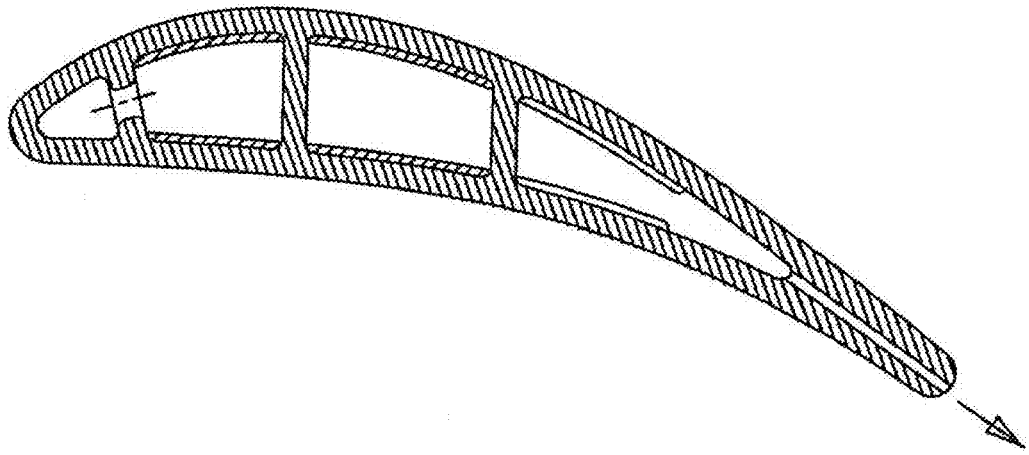
Fig 2 Prior Art
FIG. 2 shows a cross section top view of the prior art blade cooling circuit of FIG. 1.
Figure 3:
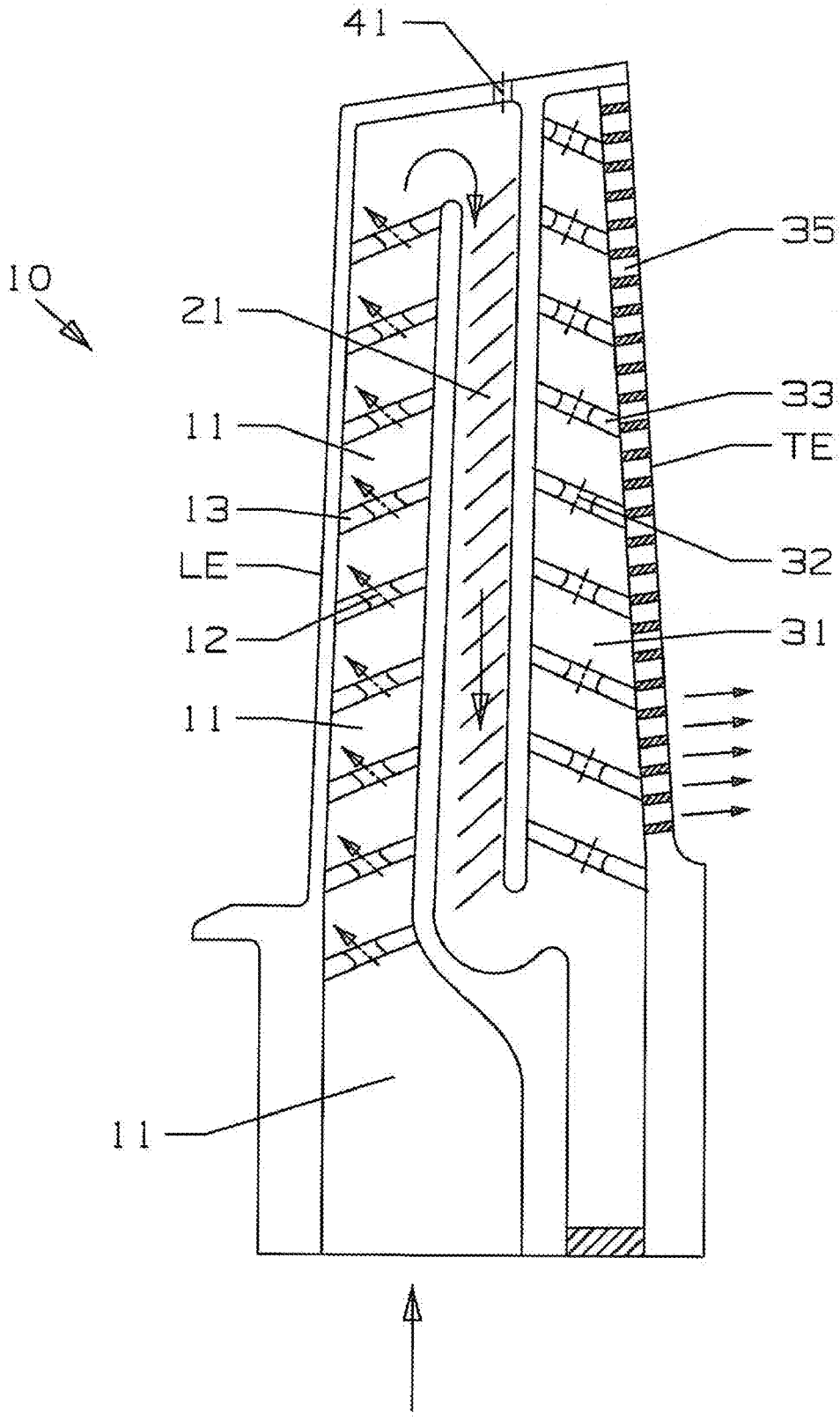
FIG. 3 shows a cross section side view of the turbine rotor blade triple pass serpentine flow cooling circuit of the present invention.

FIG. 1 shows the turbine rotor blade with the cooling circuit of the present invention for a gas turbine engine which can be an industrial or an aero engine. The cooling circuit of the present invention is for a rotating blade and not for a static guide vane because the circuit makes use of the centrifugal forces developed due to the rotation of the blade. As seen in FIG. 3, the blade 10 includes a triple pass (3-pass) serpentine flow cooling circuit, but can make use of a five-pass serpentine without departing from the filed of the invention.

The blade 10 includes a cooling air supply cavity 11 formed within the root section that is connected to an external cooling air source. The blade includes an airfoil section with a leading edge (LE) and a trailing edge (TE). A first leg or channel of the 3-pass serpentine circuit is located along the leading edge section of the airfoil and is formed by a series of impingement cavities 11 extending the length of the leg along the leading edge. The impingement cavities 11 are formed by slanted ribs 13 that slant toward the leading edge wall for reasons described below. Each rib 13 includes an impingement hole 12 directed to discharge impingement cooling air against the backside surface of the leading edge wall of the airfoil. The size and spacing of the impingement cavities 11 can vary depending upon the airfoil shape and amount of cooling required for the blade. The impingement holes 12 and 32 are also metering holes in that the holes can be sized to meter the cooling air flow from one cavity to the next.

A second leg or channel 21 of the serpentine is connected to the first leg 11 by a tip turn and flows downward toward the blade root. The second leg 21 includes trip strips along the pressure and suction sidewalls of the leg to promote cooling of these wall sections, but does not include impingement cavities in order to minimize the pressure loss between the first leg 11 and the third leg 31. The down-pass leg or channel is without impingement cavities to form a continuous and open channel to minimize the cooling pressure loss. Trip strips are used on the sidewalls of the down-pass channel or channels to provide better cooling for the walls while minimizing the loss in cooling air pressure. A trade-off occurs between minimizing the cooling air pressure loss and providing cooling for the sidewalls of the down-pass channel. The tip turn can include a tip-cooling hole 41 to discharge some of the cooling air and provide cooling for the blade tip.

A third leg or channel 31 is located along the trailing edge region and is connected to a row of trailing edge exit slots 35 to discharge the cooling air from the serpentine flow circuit and to provide additional cooling for the trailing edge. The third leg 31 is also an up-pass leg and therefore can make use of the centrifugal force due to rotation of the blade. The third leg 31 is formed also by a series of impingement cavities 31 separated by slanted ribs 33 that have impingement holes 32 formed therein directed to discharge impingement cooling air against the backside surface of the trailing edge wall.

Figure 4:
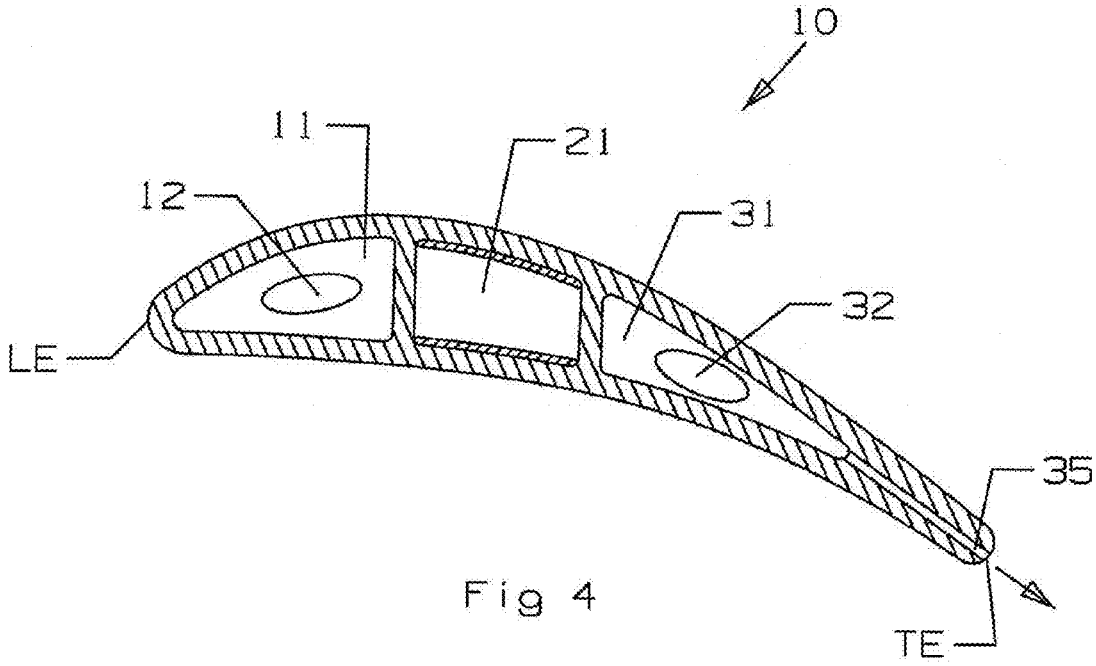
FIG. 4 shows a cross section top view of the blade cooling circuit of the present invention.

The blade 10 with the 3-pass serpentine flow cooling circuit and the impingement cavities along the up-pass legs can all be cast during the same casting process so that the manufacturing costs are low. The trailing edge exit slots can be machined into the blade after the casting process. Any film holes and tip cooling holes can also be machined after the casting process. FIG. 4 shows a cross section top view of the blade cooling circuit of FIG. 3. As seen in FIG. 4, no film cooling holes are needed on the leading edge of the blade due to the series of impingement cavities used in the present invention. Thus, less cooling airflow is required over the prior art FIG. 1 blade cooling circuit because none of the cooling air in the leading edge leg is discharged from the serpentine circuit. The leading edge is kept cool by the series of impingement cavities aided by the centrifugal effect due to the blade rotation.

Due to a pumping effect of the centrifugal force, the cooling air pressure in the up-pass legs will increase as the cooling air travels toward the blade tip. Each impingement cavity will have a higher pressure than the upstream cavity due to the cavity being located nearer to the blade tip. The centrifugal force acting on the cooling air pressure increases as the radial distance of the impingement cavity from the rotational axis increases. In other words, the centrifugal force at the blade tip is greater than at the root section, and therefore the cooling air pressure due to the centrifugal effect will be greater at the blade tip. The increase in the cooling supply pressure will be consumed by the multiple impingement cavities spaced along the leading edge flow channel. A balanced cooling air pressure within the leading edge flow channel will minimize the over-pressure across the impingement hole at the blade upper span.

The spent cooling air from the first leg 11 radial flow channel will continue to flow into the second leg of the serpentine flow circuit. However, the second leg 21 is a down-pass leg and flows against the rotational effect and thus induces a negative pressure effect on the cooling air. Thus, the second leg (down-pass leg) uses no multiple impingement cavities but only trip strips in order to maximize the blade outflow margin or OFM.

The spent cooling air flow from the second leg 21 then flows into the third leg (another up-pass leg) of the serpentine flow circuit to form the 3-pass serpentine flow circuit to complete the blade cooling flow circuit. In order to minimize the over-pressure across the blade trailing edge and consume the pressure rise due to centrifugal forces from blade rotation, the multiple impingement cooling cavities of the first leg 11 is used also in the third leg 31 of the serpentine flow cooling circuit. Each individual impingement hole is either up-pass leg can be used as a metering hole for metering the cooling air pressure in the span wise direction and distribute the cooling air through the airfoil trailing edge uniformly to yield a desirable metal temperature for the airfoil.

If needed, any of the leg of the serpentine flow circuit of the present invention can include a row of film cooling holes on the pressure side wall or the suction side wall or both in order to provide additional cooling for the blade.

We claim the following:

1. A turbine rotor blade comprising:

an airfoil section with a leading edge and a trailing edge;

a serpentine flow cooling circuit formed within the airfoil;

the serpentine flow cooling circuit including an up-pass leg and a down-pass leg;

the up-pass leg being formed by a series of impingement cavities separated by slanted ribs each with an impingement hole to direct impingement cooling air against a backside surface of the airfoil wall; and, the down-pass leg being an open channel along an entire length of the channel;

wherein rotation of the blade produces a centrifugal force on the cooling air flow that acts to increase the pressure of the cooling air flowing in the up-pass leg.

2. The turbine rotor blade of claim 1, and further comprising:

the first leg of the serpentine flow cooling circuit is an up-pass leg located along the leading edge of the airfoil; and, the first leg is without film cooling holes.

3. The turbine rotor blade of claim 2, and further comprising:

the serpentine flow cooling circuit is a 3-pass serpentine with a third leg located along the trailing edge region; and, the third leg is an up-pass leg and formed by a series of impingement cavities separated by slanted ribs each with an impingement hole to direct impingement cooling air against a backside surface of the airfoil wall.

4. The turbine rotor blade of claim 3, and further comprising:

the third leg is connected to a row of cooling air exit slots arranged along the trailing edge region of the airfoil.

5. The turbine rotor blade of claim 1, and further comprising:

the down-pass leg includes trip strips along the side walls of the leg.

6. The turbine rotor blade of claim 1, and further comprising:

the airfoil section is without film cooling holes.

* * * * *